US007119485B2

(12) United States Patent
Iwasaki

(10) Patent No.: US 7,119,485 B2
(45) Date of Patent: Oct. 10, 2006

(54) CATHODE-RAY TUBE APPARATUS

(75) Inventor: Katsuyo Iwasaki, Nishinomiya (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 115 days.

(21) Appl. No.: 11/030,741

(22) Filed: Jan. 6, 2005

(65) Prior Publication Data

US 2005/0162060 A1 Jul. 28, 2005

(30) Foreign Application Priority Data

Jan. 23, 2004 (JP) ..... 2004-015732

(51) Int. Cl.
*H01J 29/70* (2006.01)

(52) U.S. Cl. ..... 313/440; 335/213; 335/299

(58) Field of Classification Search ..... None
See application file for complete search history.

(56) References Cited

U.S. PATENT DOCUMENTS 7,012,360 B1 * 3/2006 Iwasaki et al. ..... 313/477 R
2005/0057694 A1 * 3/2005 Iwasaki ..... 348/719
2005/0225268 A1 * 10/2005 Sakurai et al. ..... 315/368.25

FOREIGN PATENT DOCUMENTS

| | | |
|---|---|---|
| EP | 0 484 606 | 5/1992 |
| EP | 1 233 439 | 8/2002 |
| EP | 1 460 673 | 9/2004 |
| JP | 57-45650 | 10/1982 |
| JP | 6-283113 | 10/1994 |

* cited by examiner

*Primary Examiner*—Ashok Patel
(74) *Attorney, Agent, or Firm*—Hamre, Schumann, Mueller & Larson, P.C.

(57) ABSTRACT

BVM coils for modulating a scanning velocity in a horizontal direction of electron beams emitted from an electron gun are provided at a position where the BVM coils are overlapped with an electron gun in a tube axis direction, and a pair of magnetic substance pieces are provided at a position where the pair of magnetic substance pieces are overlapped with the BVM coils in the tube axis direction. The pair of magnetic substance pieces surround a funnel continuously in a circumferential direction of an outer circumferential surface of the funnel, except for a portion of the surface that intersects a plane defined by the tube axis and a vertical direction axis, and the vicinity of that portion. Because of this, a cathode-ray tube apparatus with the sensitivity of the BVM coils enhanced can be provided.

2 Claims, 8 Drawing Sheets

CATHODE-RAY TUBE APPARATUS

BACKGROUND OF THE INVENTION

1. Field of the Invention

The present invention relates to a cathode-ray tube apparatus.

2. Description of the Related Art

In order to correct an edge of a displayed image to enhance image quality, a method for modulating the horizontal scanning velocity of electron beams is known. According to this method, in general, a pair of auxiliary coils called beam velocity modulation (BVM) coils are provided at a neck portion of a cathode-ray tube so as to be integrated with a deflection yoke and a convergence and purity unit (CPU) (see JP57(1982)-45650Y).

The BVM coils improve a visible state between a dark area and a light area of an image displayed on a screen during a horizontal scanning period as follows. The transition of a lighting state is predicted from a video signal waveform. In a period on a dark side during a transition period of a lighting state, electron beams are accelerated so that they are horizontally scanned at a velocity equal to or higher than an average scanning velocity. On the other hand, in a period on a light side during the transition period of a lighting state, electron beams are decelerated so that they are horizontally scanned at a velocity equal to or lower than the average scanning velocity. Thus, among the areas of the transition of a lighting state on a screen, in an area on a dark side, an excitation time of phosphors is shortened to decrease brightness, and in an area on a light side, an excitation time of phosphors is prolonged to increase brightness. Accordingly, the edge of an image is corrected so as to increase the sharpness of the areas of the transition of lightness and darkness.

In the case where the above-mentioned BVM coils for modulating the horizontal scanning velocity of electron beams are provided so as to be integrated with the CPU, an eddy current is excited in an electron gun made of a metallic conductor due to the magnetic flux generated by the BVM coils, and the metallic conductor generates heat, resulting in a reduction in the velocity modulation effect by the BVM coils.

In order to enhance the sensitivity of the BVM coils, a method has been proposed for mounting a magnetic substance, which focuses and intensifies the magnetic field generated by the BVM coils, in the electron gun (see JP6(1994)-283113A).

However, the above-mentioned method has the following problems: since a magnetic substance for focusing a magnetic field is metal, a new eddy current is likely to be generated; a process for welding a new component is necessary, which increases a cost; and furthermore, sufficient sensitivity cannot be obtained.

Furthermore, it also is considered that, in order to decrease crosstalk between the magnetic field generated by the BVM coils and the electron gun metal to minimize the generation of an eddy current, the BVM coils should be placed close to the end of a deflection yoke on the electron gun side. However, in this case, the BVM coils are placed close to a horizontal deflection coil, so that crosstalk between the magnetic field generated by the BVM coils and the horizontal deflection magnetic field is increased to cause new ringing. Therefore, there is a limit for placing the BVM coils close to the deflection yoke, and hence, a sufficient increase in sensitivity cannot be realized.

SUMMARY OF THE INVENTION

The present invention solves the above-mentioned conventional problems, and its object is to provide a cathode-ray tube apparatus in which the sensitivity of BVM coils is enhanced by a simple procedure without increasing the winding number and the driving voltage of the BVM coils, without causing the generation of a new eddy current, the increase in cost due to the addition of processing steps, and the occurrence of ringing, and without influencing the characteristics of a cathode-ray tube (e.g., without causing the distortion in upper and lower portions of an image).

In order to achieve the above-mentioned object, a cathode-ray tube apparatus of the present invention includes: a panel having a phosphor screen formed on an inner surface thereof; a funnel connected to the panel; an electron gun housed in a neck portion of the funnel; a deflection yoke for deflecting electron beams emitted from the electron gun in a horizontal direction and a vertical direction, provided on an outer circumferential surface of the funnel; BVM coils for modulating a scanning velocity in the horizontal direction of the electron beams emitted from the electron gun, provided at a position where the BVM coils are overlapped with the electron gun in a tube axis direction; and a pair of magnetic substance pieces provided at a position where the pair of magnetic substance pieces are overlapped with the BVM coils in the tube axis direction. The pair of magnetic substance pieces surround the funnel continuously in a circumferential direction of the outer circumferential surface of the funnel, except for a portion of the surface that intersects a plane defined by the tube axis and a vertical direction axis, and the vicinity of that portion.

These and other advantages of the present invention will become apparent to those skilled in the art upon reading and understanding the following detailed description with reference to the accompanying figures.

DESCRIPTION OF THE PREFERRED EMBODIMENTS

According to the present invention, a pair of magnetic substance pieces are provided at a position where the pair of magnetic substance pieces are overlapped with BVM coils in a tube axis direction, so that the sensitivity of the BVM coils is enhanced.

Furthermore, the pair of magnetic substance pieces have openings on a portion of a surface that intersects a plane defined by the tube axis and a vertical direction axis, so that a leakage magnetic field of a vertical deflection magnetic field on a small diameter side of a deflection yoke is hardly influenced by mounting the pair of magnetic substance pieces. Thus, the characteristics of rasters in upper and lower portions of a screen, a convergence in a corner portion of the screen, and the like are hardly varied, even when the pair of magnetic substance pieces are mounted. Consequently, it is possible to determine freely whether the pair of magnetic substance pieces are mounted or not in a cathode-ray tube apparatus of the same specification, in accordance with the use and request characteristics of the cathode-ray tube apparatus.

In the above-mentioned cathode-ray tube apparatus of the present invention, it is preferable that a horizontal deflection coil of the deflection yoke and the BVM coils are placed apart from each other in the tube axis direction. According to this configuration, the occurrence of ringing between a magnetic field generated by the horizontal deflection coil and a magnetic field generated by the BVM coils can be prevented.

Hereinafter, the cathode-ray tube apparatus of the present invention will be described in detail by way of preferable embodiments.

Embodiment 1

Figure 1:
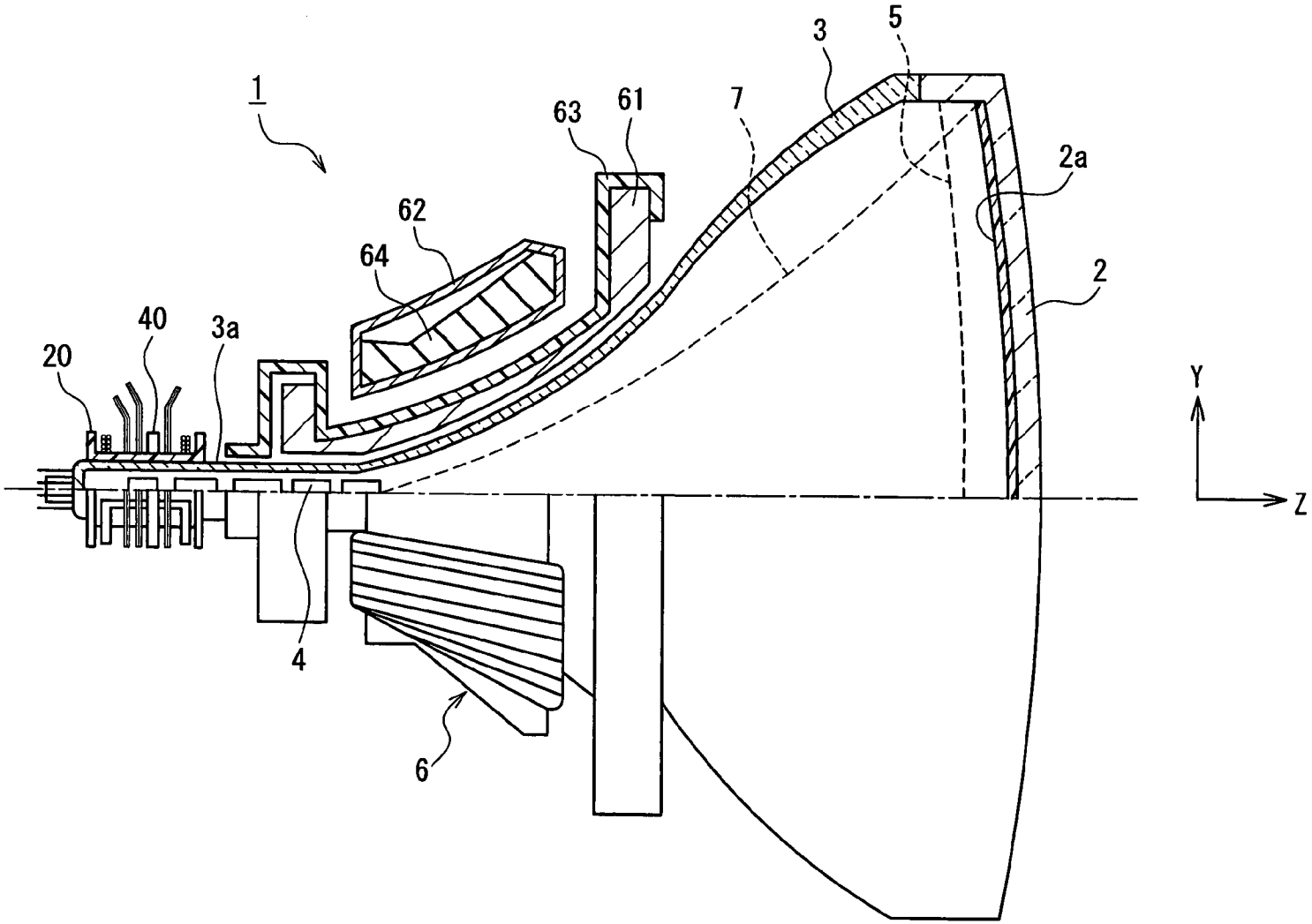
FIG. 1 is a partial cross-sectional view showing a schematic configuration of a color picture tube apparatus according to one embodiment of the present invention.

In Embodiment 1, a color picture tube apparatus will be exemplified as the cathode-ray tube apparatus. FIG. 1 is a view showing a configuration of a color picture tube apparatus according to Embodiment 1 of the present invention. For convenience of the following description, it is assumed that a tube axis is a Z-axis, an axis in a horizontal direction (long side direction of a screen) is an X-axis, and an axis in a vertical direction (short side direction of a screen) is a Y-axis. The X-axis and the Y-axis cross each other on the Z-axis. In FIG. 1, a cross-sectional view and an outer appearance view are shown on an upper side and a lower side of the Z-axis, respectively.

A color picture tube (CRT) includes an envelope composed of a panel 2 and a funnel 3, and an electron gun 4 provided in a neck portion 3*a* of the funnel 3. A color picture tube apparatus 1 includes the color picture tube and a deflection yoke 6 mounted on an outer circumferential surface of the funnel 3. On an inner surface of the panel 2, a phosphor screen 2*a* is formed, in which respective phosphor dots (or phosphor stripes) of blue (B), green (G), and red (R) are arranged. A shadow mask 5 is attached to an inner wall surface of the panel 2 so as to be opposed to the phosphor screen 2*a*. The shadow mask 5 is made of a metallic plate with a number of substantially slot-shaped apertures, which are electron beam passage apertures, formed by etching, and three electron beams 7 (three electron beams are arranged in a line parallel to the X-axis, so that only one electron beam on the front side is shown in FIG. 1) emitted from the electron gun 4 pass through the apertures to strike predetermined phosphor dots. The deflection yoke 6 deflects the three electron beams 7 emitted from the electron gun 4 in vertical and horizontal directions to allow them to scan the phosphor screen 2*a*. The deflection yoke 6 includes a saddle-type horizontal deflection coil 61, a toroidal vertical deflection coil 62, and a ferrite core 64. An insulating frame 63 made of resin is provided between the horizontal deflection coil 61 and the vertical deflection coil 62. The insulating frame 63 plays the role of maintaining electrical insulation between the horizontal deflection coil 61 and the vertical deflection coil 62.

Figure 2:
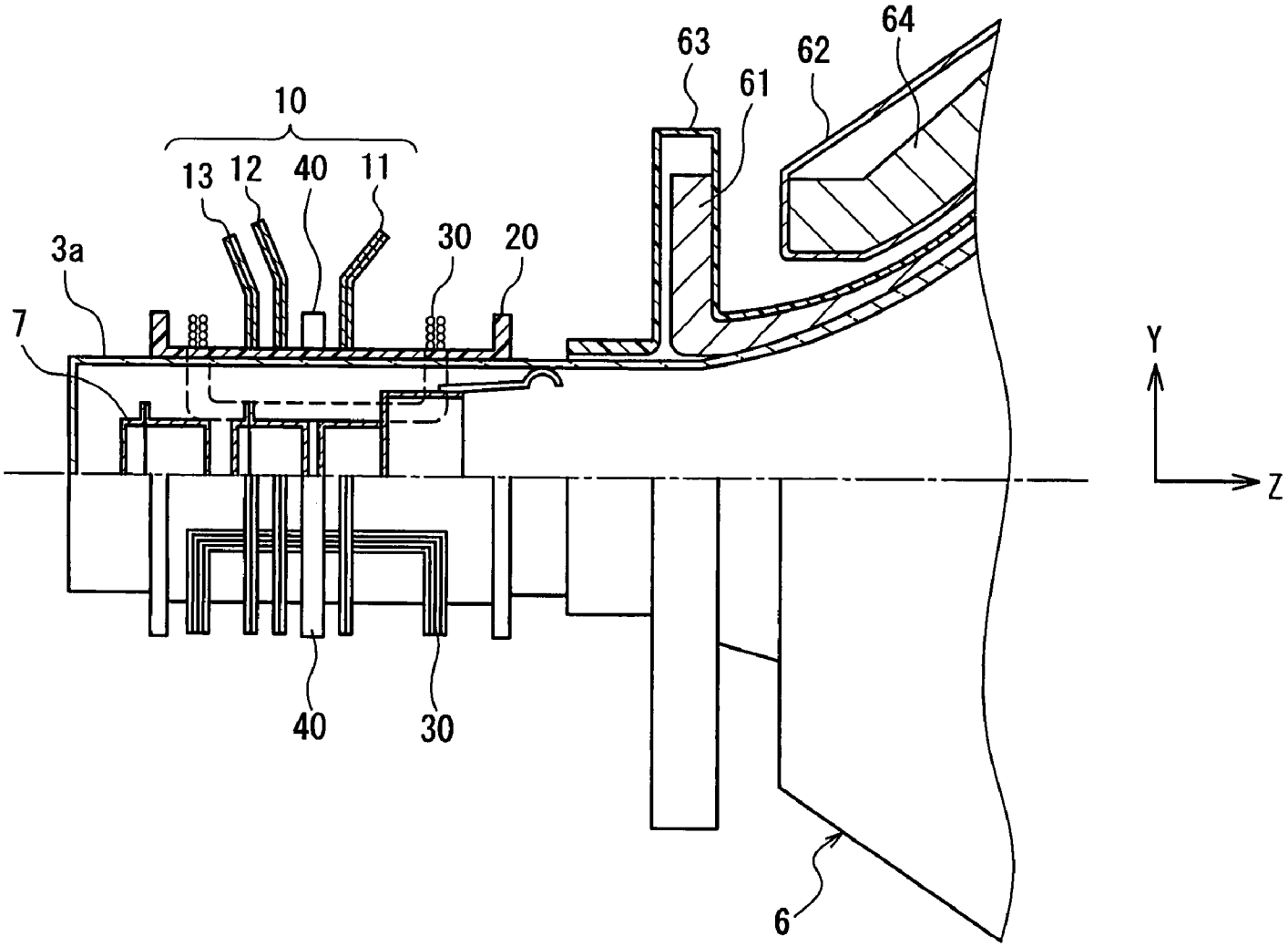
FIG. 2 is a partial cross-sectional view showing a configuration of the circumference of an electron gun of the color picture tube apparatus according to one embodiment of the present invention.

FIG. 2 is a view showing the circumferential configuration of the electron gun 4. In FIG. 2, reference numeral 10 denotes a convergence and purity unit (CPU), which adjusts a static convergence and purity of electron beams at the center of a screen (i.e., phosphor screen 2*a*). The CPU 10 includes a dipole magnet ring 11, a quadrupole magnet ring 12, and a hexapole magnet ring 13. The respective dipole, quadrupole, and hexapole magnet rings 11, 12, and 13 are configured by stacking two annular magnets. Reference numeral 20 denotes a substantially cylindrical holder for holding the respective dipole, quadrupole, and hexapole magnet rings 11, 12, and 13. The holder 20 is externally placed on an outer circumference of the neck portion 3*a*.

Reference numeral 30 denotes a pair of beam velocity modulation (BVM) coils provided so as to be substantially symmetrical with respect to an XZ-plane with the XZ plane interposed therebetween. Windings thereof are placed along the outer circumferential surface of the holder 20 to generate a magnetic field in a substantially Y-axis direction. The function of the BVM coils 30 is the same as that of the conventional example, so that the detailed description thereof will be omitted here. In the Z-axis direction, the BVM coils 30 are placed so as to be overlapped with a position where a main lens portion of the electron gun 4 is formed, and so as to be spaced at a predetermined distance from the horizontal deflection coil 61, in such a manner that ringing due to the crosstalk with respect to the horizontal deflection magnetic field generated by the horizontal deflection coil 61 does not occur.

Reference numeral 40 denotes a pair of magnetic substance pieces for intensifying the magnetic field density of the BVM coils 30.

Figure 3:
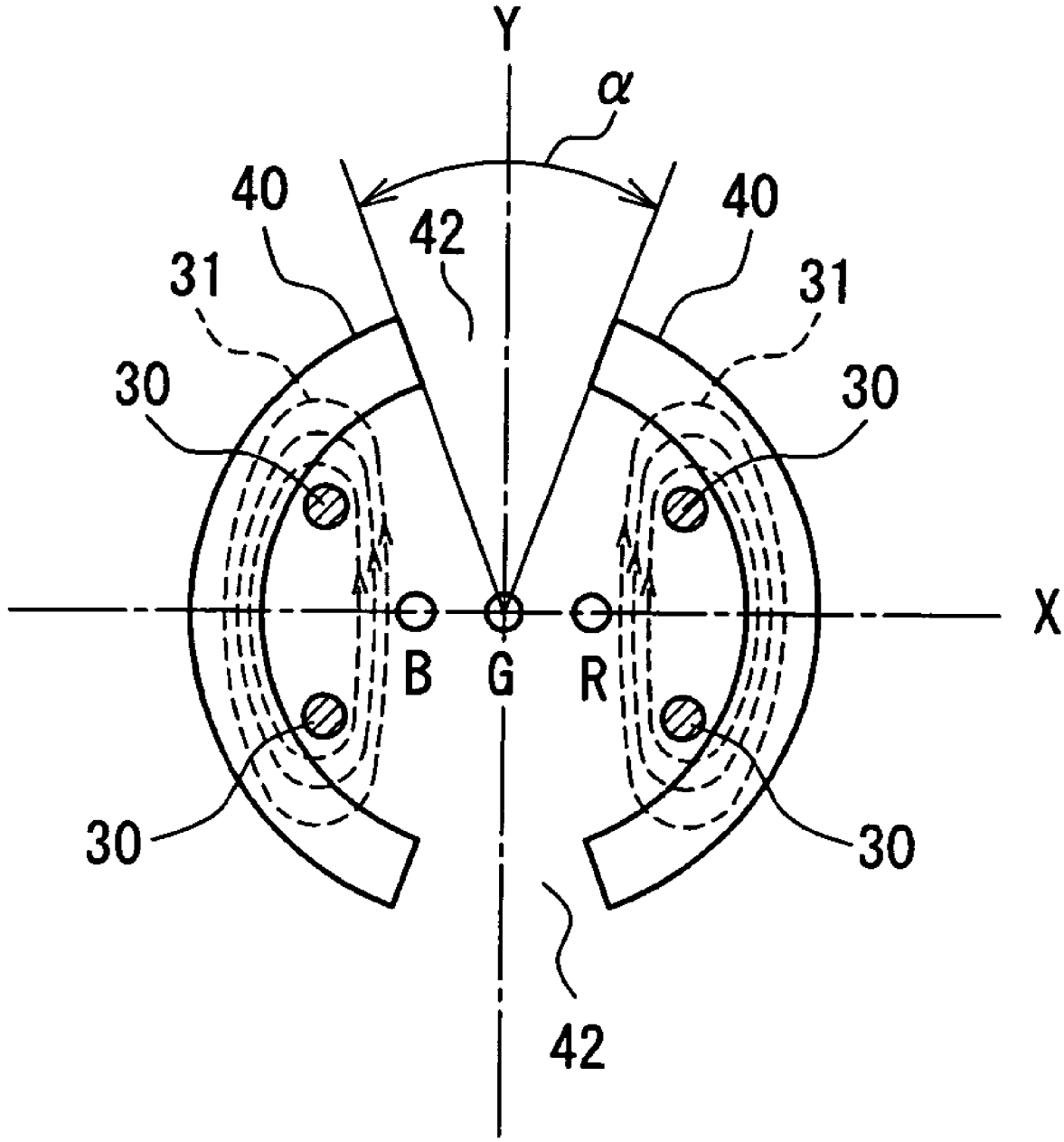
FIG. 3 is a diagram illustrating the action of a pair of magnetic substance pieces with respect to a magnetic field generated by BVM coils in the color picture tube apparatus according to one embodiment of the present invention.

FIG. 3 is a cross-sectional view of the pair of magnetic substance pieces 40 and the BVM coils 30, taken along a surface perpendicular to the Z-axis. In FIG. 3, R, G, and B represent electron beams of red, green, and blue, and a dotted line 31 denotes a magnetic flux generated by the BVM coils 30. For simplicity of the drawings, peripheral members such as the funnel 3, the holder 20, and the like are not shown.

As shown in FIG. 3, each magnetic substance piece 40 has an arc shape, and is mounted on an outer circumferential surface of the holder 20 (see FIG. 2) so as to be placed apart from each other with a YZ-plane interposed therebetween and symmetrically with respect to the YZ-plane. The pair of magnetic substance pieces 40 surround the funnel 3 continuously in a circumferential direction of the outer circumferential surface of the funnel 3, except for openings 42 on the YZ-plane. As shown in FIG. 2, the position of the pair of magnetic substance pieces 40 in the Z-axis direction is overlapped with an arrangement region of the BVM coils 30 in the Z-axis direction.

Figure 4A:
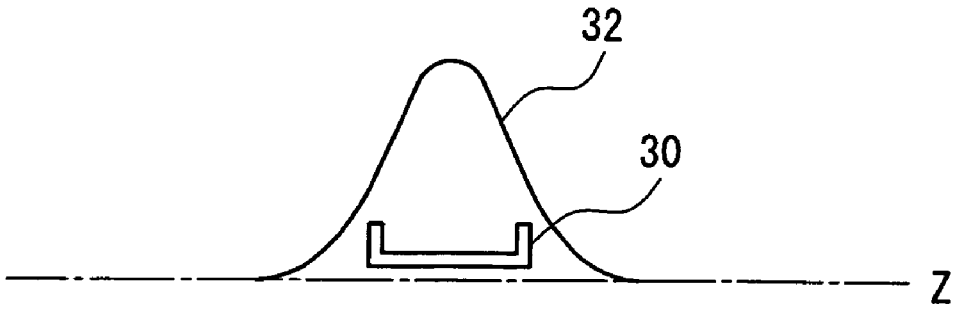
FIG. 4A is a conceptual diagram showing BVM coils and an intensity distribution in a Z-axis direction of a magnetic field generated by the BVM coils in the case where a pair of magnetic substance pieces are not provided.
Figure 4B:
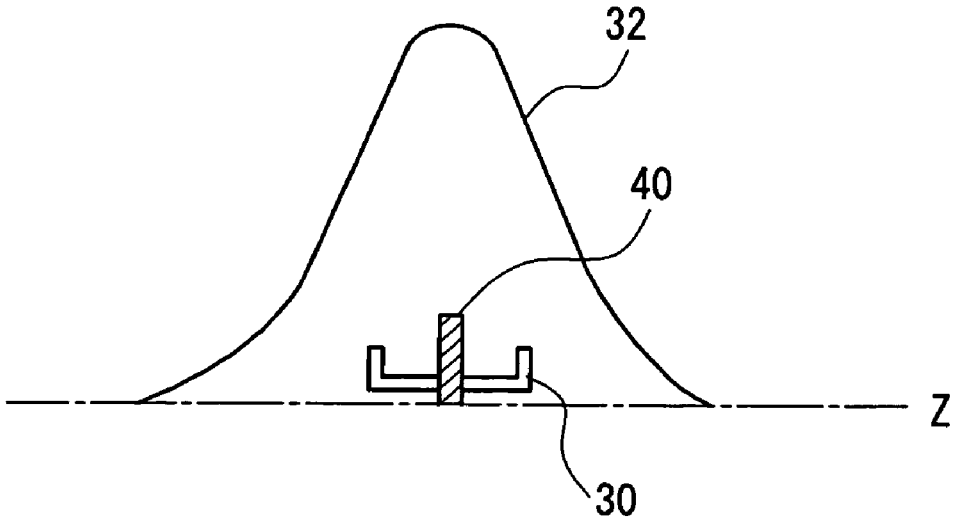
FIG. 4B is a conceptual diagram showing the BVM coils and an intensity distribution in the Z-axis direction of a magnetic field generated by the BVM coils in the case where a pair of magnetic substance pieces are provided.

The action of the pair of magnetic substance pieces 40 with respect to the magnetic flux 31 generated by the BVM coils 30 will be described with reference to FIGS. 3, 4A, and 4B. FIG. 4A is a conceptual diagram showing the BVM coils 30 and the intensity distribution in the Z-axis direction of a magnetic field 32 generated by the BVM coils 30 in the case where the pair of magnetic substance pieces 40 are not provided. FIG. 4B is a conceptual diagram showing, in the same way as in FIG. 4A, the BVM coils 30 and the intensity distribution in the Z-axis direction of the magnetic field 32 generated by the BVM coils 30 in the case where the pair of magnetic substance pieces 40 are provided. In FIGS. 4A and 4B, the vertical axis represents the intensity of a magnetic field.

As shown in FIG. 3, the magnetic flux 31 generated by the BVM coils 30 passes through the pair of magnetic substance pieces 40 on an outer side of the funnel 3. Thus, as shown in FIGS. 4A and 4B, the pair of magnetic substance pieces 40 enhance the intensity of the magnetic field 32 generated by the BVM coils 30 driven at a high frequency, and enlarges a distribution region of the magnetic field 32 in the Z-axis direction. Consequently, the beam modulation sensitivity by the BVM coils 30 is enhanced.

As shown in FIG. 3, the magnetic flux 31 does not cross the YZ-plane. Therefore, the fact that the pair of magnetic substance pieces 40 are divided to the right and left with the YZ-plane interposed therebetween as in the present invention hardly influences the action on the magnetic flux 31. According to one experiment conducted by the inventors of the present invention, the decrease in beam modulation sensitivity due to the BVM coils 30 in the case of using the pair of magnetic substance pieces 40 was about 5%, compared with an annular magnetic substance ring (see an annular magnetic substance ring 90 shown in FIG. 5A) without the opening 42.

Next, the action of the pair of magnetic substance pieces 40 with respect to the vertical deflection magnetic field generated by the vertical deflection coil 62 will be described.

Figure 5A:
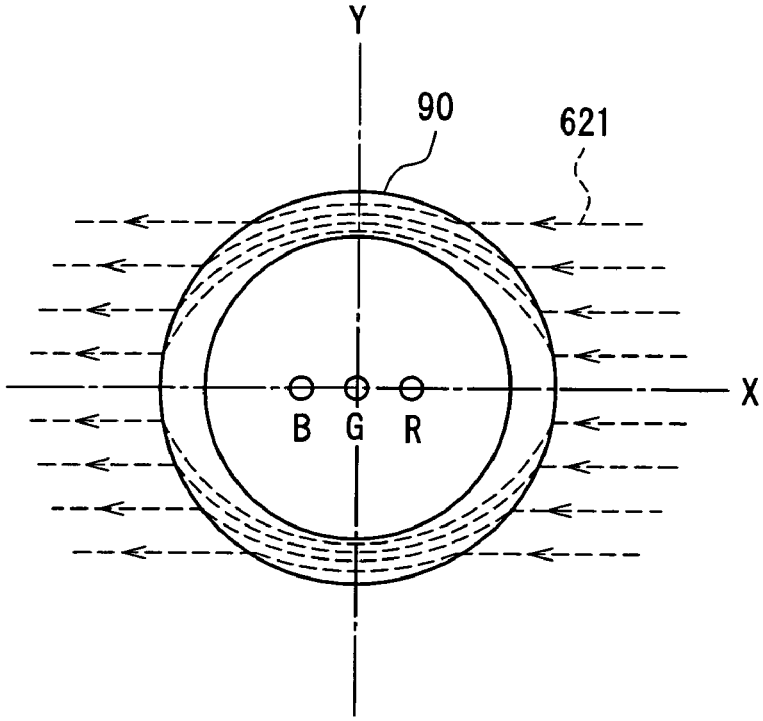
FIG. 5A is a diagram showing the action of an annular magnetic substance ring with respect to a vertical deflection magnetic field.
Figure 5B:
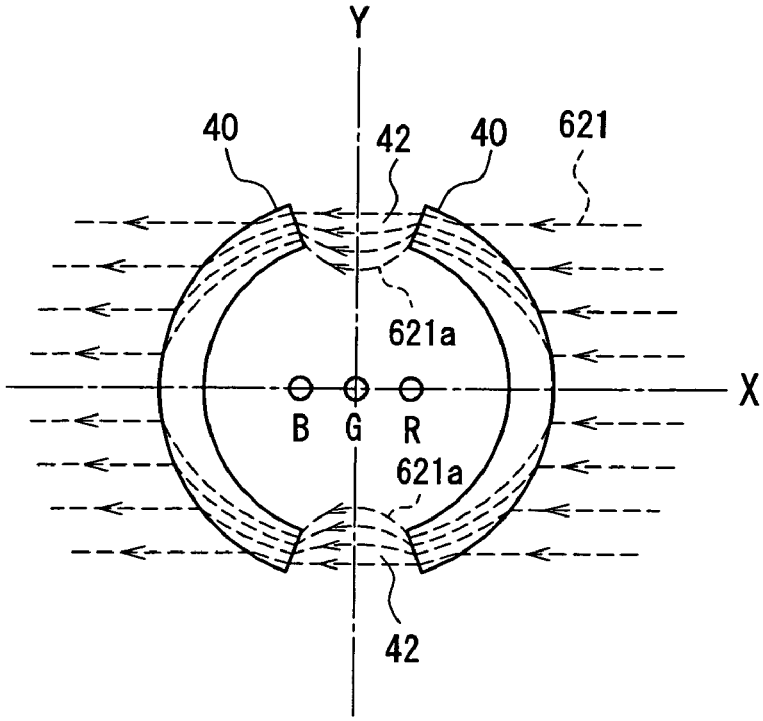
FIG. 5B is a diagram showing the action of a pair of magnetic substance pieces of the present invention with respect to a vertical deflection magnetic field.

FIG. 5A is a diagram showing the action of the annular magnetic substance ring 90 with respect to the vertical deflection magnetic field generated by the vertical deflection coil 62. FIG. 5B is a diagram showing the action of the pair of magnetic substance pieces 40 of the present invention with respect to the vertical deflection magnetic field. Both the figures show a state seen in a direction along to the Z-axis, and for simplicity, peripheral members such as the funnel 3, the holder 20, and the like are not shown. R, G, and B represent electron beams of red, green, and blue. In a region where the BVM coils 30 are placed, a leakage magnetic field of the vertical deflection magnetic field generated by the vertical deflection coil 62 is distributed. Reference numeral 621 denotes a magnetic flux of the vertical deflection magnetic field.

Figure 6:
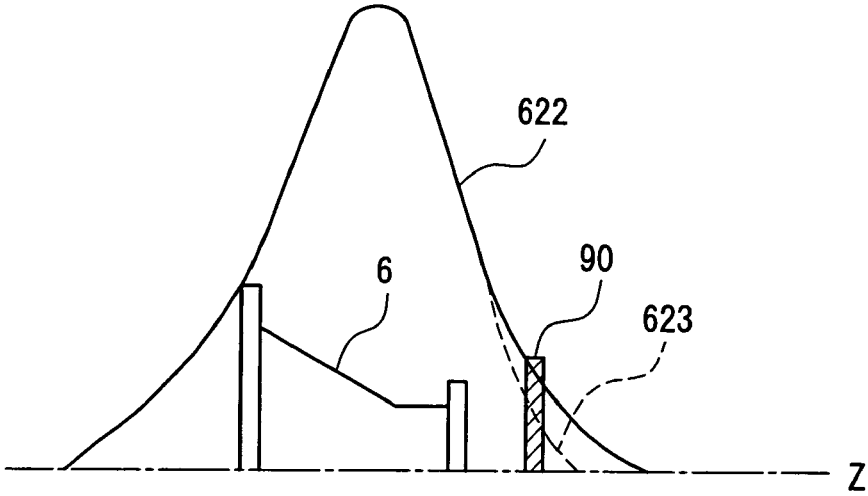
FIG. 6 is a diagram showing a state where the intensity distribution in the Z-axis direction of the vertical deflection magnetic field is varied by the annular magnetic substance ring shown in FIG. 5A.
Figure 7:
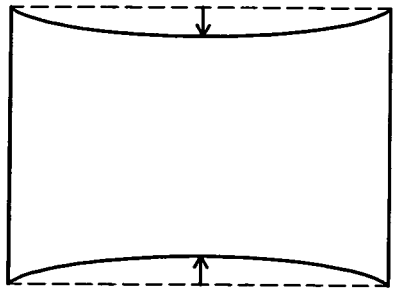
FIG. 7 is a front view showing a state where rasters in upper and lower portions of a screen are distorted in a bobbin shape.
Figure 8:
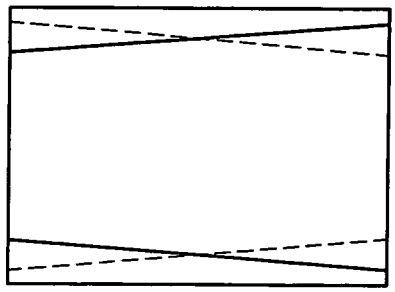
FIG. 8 is a front view showing a state where a misconvergence occurs in corner portions of the screen.

When the annular magnetic substance ring 90 as shown in FIG. 5A is placed instead of the pair of magnetic substance pieces 40, the magnetic flux 621 substantially along the X-axis is absorbed by the magnetic substance ring 90 to pass through the inside thereof. More specifically, the leakage magnetic flux 621 of the vertical deflection magnetic field on the periphery of the magnetic substance ring 90 is absorbed by the magnetic substance ring 90. Thus, as shown in FIG. 6, by mounting the magnetic substance ring 90, the intensity distribution in the Z-axis direction of a vertical deflection magnetic field 622 before the magnetic substance ring 90 is mounted is weakened in the vicinity of the magnetic substance ring 90 on a small diameter side of the deflection yoke 6 as represented by a dotted line 623. Consequently, the vertical deflection magnetic field and the horizontal deflection magnetic field get out of balance, whereby rasters in upper and lower portions of a screen are distorted in a bobbin shape as shown in FIG. 7, and a convergence is degraded in corners of the screen as shown in FIG. 8.

In contrast, the pair of magnetic substance pieces 40 of the present invention have the openings 42 on the YZ-plane. More specifically, the pair of magnetic substance pieces 40 have a shape obtained by removing portions in the vicinity of the YZ-plane from the annular magnetic substance ring 90 shown in FIG. 5A. Thus, as shown in FIG. 5B, the magnetic flux 621 absorbed by the pair of magnetic substance pieces 40 expands in the Y-axis direction when passing through the openings 42, and an expanded magnetic flux 621*a* suppresses the decrease in vertical deflection magnetic field intensity as represented by the dotted line 623 in FIG. 6. Thus, the distribution in the Z-axis direction of the vertical deflection magnetic field is hardly varied depending upon the presence/absence of the pair of magnetic substance pieces 40 of the present invention. This means the following: in the color picture tube apparatus with the BVM coils 30 mounted thereon, it is not necessary to perform two kinds of designs having different specifications in accordance with whether or not a magnetic substance for enhancing the sensitivity of the BVM coils is attached, whereby the design specification of the color picture tube apparatus can be made uniform.

In one example, the pair of magnetic substance pieces 40 were formed in an arc shape with a thickness (dimension in the Z-axis direction) of 2.0 mm, an inner diameter of $\phi$38 mm, and an outer diameter of $\phi$44 mm, also considering the mechanical strength. The pair of magnetic substance pieces 40 were made of a ferrite material having a specific resistance of about $10^4$ $\Omega\cdot$m. Furthermore, as shown in FIG. 3, a spread angle $\alpha$ seen from the Z-axis of the opening 42 between the pair of magnetic substance pieces 40 was set to be 60°. Because of this, the sensitivity of the BVM coils 30 was enhanced by 1.5 to 2 times, compared with the case where the pair of magnetic substance pieces 40 were not provided. Furthermore, it was confirmed that raster distortion in upper and lower portions of an image is hardly varied by mounting the pair of magnetic substance pieces 40. Thus, it was found that it is possible to freely determine whether the pair of magnetic substance pieces 40 are mounted or not in the color picture tube apparatus of the same specification, in accordance with the use and request characteristics of the color picture tube apparatus.

Figure 9:
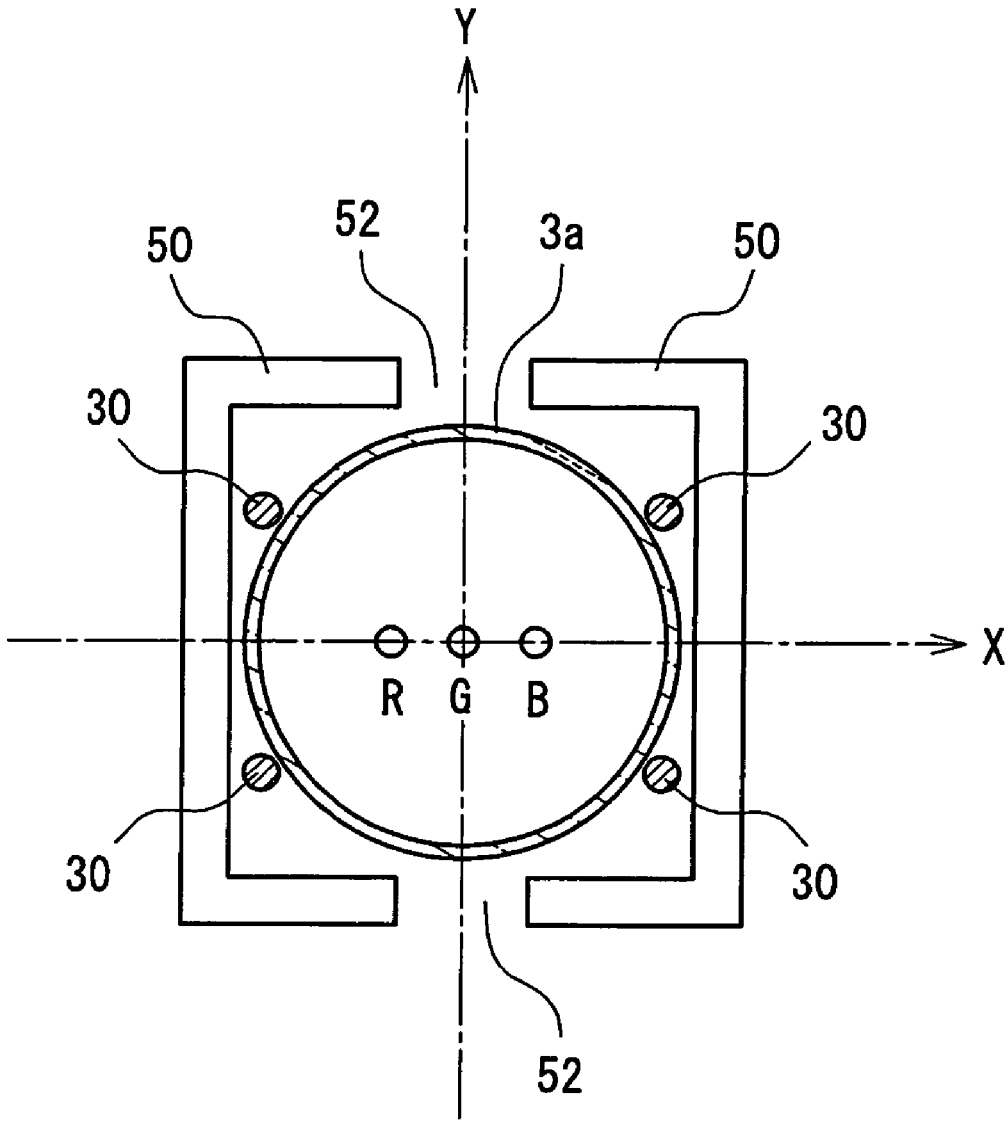
FIG. 9 is a front view showing another example of a pair of magnetic substance pieces in the color picture tube apparatus according to one embodiment of the present invention.

The pair of magnetic substance pieces 40 described in the above-mentioned embodiment have a substantially arc shape. However, the present invention is not limited thereto. For example, as shown in FIG. 9, a pair of magnetic substance pieces 50 each having a substantially "U" shape may be used, in which a magnetic substance in a substantially rectangular frame shape has openings 52 formed in portions that cross the YZ-plane and in portions in the vicinity thereof. In any case, the magnetic substance pieces 50 only need to include openings in portions that cross the YZ-plane, and to be continuous in a circumferential direction of the neck portion 3*a* of the funnel 3 so as to surround the neck portion 3*a*.

Furthermore, in the above-mentioned embodiment, although the deflection yoke 6 and the CPU 10 are separated from each other, they may be integrated, and even in this case, the effects similar to those described above are exhibited.

In the above-mentioned embodiment, although the CPU 10 includes the dipole, quadrupole, and hexapole magnet rings 11, 12, and 13 on a one-by-one basis, the CPU 10 may lack one or two among them. Furthermore, two or more magnet rings of the same kind may be provided.

Furthermore, the numerical values in the above-mentioned example are shown merely for illustrative purpose, and the present invention is not limited thereto. The degree of a leakage magnetic field of the vertical deflection magnetic field with respect to the vicinity of the pair of magnetic substance pieces is varied depending upon the system of the deflection yoke, the size of the cathode-ray tube, and the like. Therefore, for example, the value of the spread angle $\alpha$ of the opening can be changed appropriately. Furthermore, the material for the pair of magnetic substance pieces is not limited to a ferrite material used in the above example. Any material may be used as long as it is unlikely to generate an eddy current. Furthermore, a molded resin in which a metal magnetic substance or ferrite powder is dispersed may be used.

Embodiment 2

Figure 10:
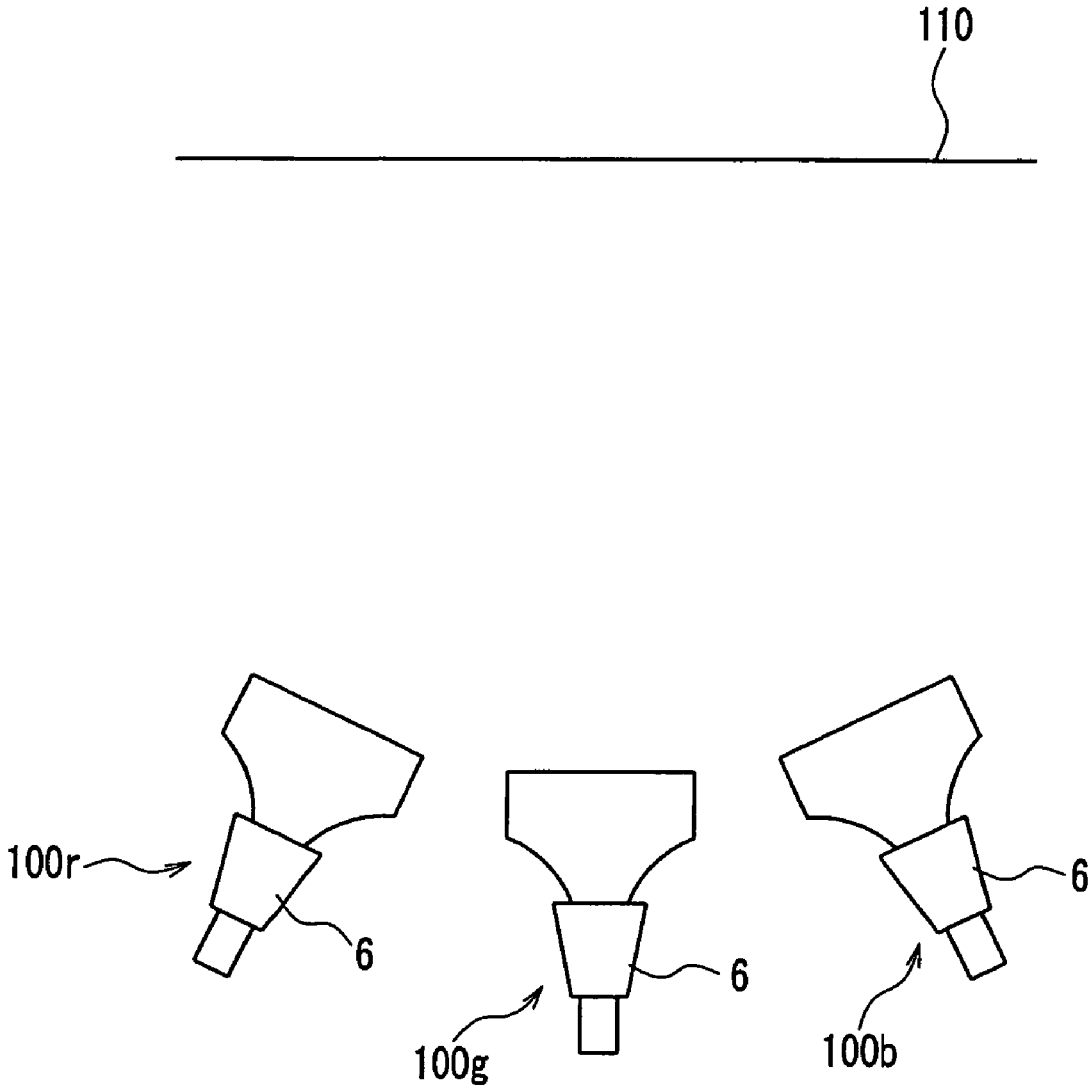
FIG. 10 is a view showing a schematic configuration of a projection tube set with monochrome tube apparatuses mounted thereon according to one embodiment of the present invention.

In Embodiment 2, a monochrome tube apparatus used in a projection tube set such as a projection TV will be exemplified as the cathode-ray tube apparatus. FIG. 10 is a view showing a schematic configuration of the projection tube set. Each raster of red, green, and blue respectively generated by monochrome tube apparatuses 100*r*, 100*g*, and 100*b* is projected onto a rear projection screen 110, whereby a color image is formed on the screen 110. A reflection mirror for bending an optical path may be provided between the monochrome tube apparatuses 100*r*, 100*g*, and 100*b*, and the screen 110.

The monochrome tube apparatuses 100*r*, 100*g*, and 100*b* according to Embodiment 2 to which the present invention is applied respectively generate monochrome light. Thus, the monochrome tube apparatuses 100*r*, 100*g*, and 100*b* of the present embodiment are different from the color picture tube apparatus of Embodiment 1 mainly in the following points.

Each electron gun of the monochrome tube apparatuses 100*r*, 100*g*, and 100*b* emits only one electron beam. A monochrome phosphor of red, green, or blue is provided to the phosphor screen 2*a*. Thus, there is no shadow mask 5 that functions as a color selection electrode. The CPU 10 for adjusting the color purity and color displacement at the center of a screen, described in Embodiment 1, is not present. It should be noted that, in order to form a spot of an electron beam in a substantially circular shape at the center of the screen 110, a quadrupole magnet and/or a hexapole magnet similar to those used in the CPU 10 may be provided at the neck portion 3*a* of the funnel 3.

The basic configuration of the monochrome tube apparatuses 100*r*, 100*g*, and 100*b* of Embodiment 2 is the same as that of the color picture tube apparatus of Embodiment 1 except for the above, and the description of Embodiment 1 applies to Embodiment 2 as it is or with an appropriate change. Thus, a repeated description will be omitted here.

The applicable field of the cathode-ray tube apparatus of the present invention is not particularly limited, and the cathode-ray tube apparatus can be used in a wide range, such as a TV, a computer, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode-ray tube apparatus, comprising:

a panel having a phosphor screen formed on an inner surface thereof, a funnel connected to the panel;

an electron gun housed in a neck portion of the funnel;

a deflection yoke for deflecting electron beams emitted from the electron gun in a horizontal direction and a vertical direction, provided on an outer circumferential surface of the funnel;

BVM coils for modulating a scanning velocity in the horizontal direction of the electron beams emitted from the electron gun, provided at a position where the BVM coils are overlapped with the electron gun in a tube axis direction; and a pair of magnetic substance pieces provided at a position where the pair of magnetic substance pieces are overlapped with the BVM coils in the tube axis direction, wherein the pair of magnetic substance pieces surround the funnel continuously in a circumferential direction of the outer circumferential surface of the funnel, except for a portion of the surface that intersects a plane defined by the tube axis and a vertical direction axis, and the vicinity of that portion.

2. The cathode-ray tube apparatus according to claim 1, wherein a horizontal deflection coil of the deflection yoke and the BVM coils are placed apart from each other in the tube axis direction.

* * * * *